US012624924B2

(12) United States Patent
Eriksson et al.

(10) Patent No.: US 12,624,924 B2
(45) Date of Patent: May 12, 2026

(54) METHOD, FIRE CONTROL SYSTEM AND COMBAT SYSTEM FOR SIMULTANEOUS DETONATION OF PROJECTILES

(71) Applicant: BAE SYSTEMS BOFORS AB, Karlskoga (SE)

(72) Inventors: Frans Eriksson, Hammarö (SE); Erik Jonasson, Väse (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 18/840,122

(22) PCT Filed: Mar. 3, 2023

(86) PCT No.: PCT/SE2023/050193

§ 371 (c)(1),
(2) Date: Aug. 21, 2024

(87) PCT Pub. No.: WO2023/177339

PCT Pub. Date: Sep. 21, 2023

(65) Prior Publication Data

US 2025/0155222 A1 May 15, 2025

(30) Foreign Application Priority Data

Mar. 15, 2022 (SE) ..... 2200029-3

(51) Int. Cl.
*F41G 3/04* (2006.01)
*F41G 3/06* (2006.01)
(Continued)

(52) U.S. Cl.
CPC ..... *F41G 3/04* (2013.01); *F41G 3/06* (2013.01); *F41G 7/308* (2013.01); *F42B 10/56* (2013.01)

(58) Field of Classification Search
CPC ... F41G 3/04; F41G 3/06; F41G 7/308; F42B 10/56
(Continued)

(56) References Cited

U.S. PATENT DOCUMENTS 4,655,411 A 4/1987 Franzen et al.
5,121,672 A * 6/1992 Haglund ..... F41G 3/04 235/408
(Continued)

FOREIGN PATENT DOCUMENTS

JP 2002181495 A 6/2002
SE 468868 B 3/1993
(Continued)

OTHER PUBLICATIONS

International Search Report (May 16, 2023) for corresponding International App. PCT/SE2023/050193.

*Primary Examiner* — John Cooper
(74) *Attorney, Agent, or Firm* — Husch Blackwell LLC

(57) ABSTRACT

A method for simultaneous blasting of projectiles includes i.) calculating the position of the target, ii.) estimating the target's position, iii.) firing a first projectile at the target, iv.) firing a second projectile at the target, v.) braking the first projectile with a braking device arranged in the projectile, and vi.) detonating the projectiles in a coordinated fashion based on an initiation signal. A fire-control system for directing fire against a target comprising at least one sensor, in order to measure the position of the target as a function of time, and a combat system including a firing device are also provided.

8 Claims, 4 Drawing Sheets

(51) Int. Cl.
*F41G 7/30* (2006.01)
*F42B 10/56* (2006.01)

(58) Field of Classification Search
USPC .... 89/1.1, 41.3, 41.13, 41.4–8, 41.11, 41.12, 89/41.14, 204, 205
See application file for complete search history.

(56) References Cited

U.S. PATENT DOCUMENTS

| | | | | |
|---|---|---|---|---|
| 5,189,248 | A | 2/1993 | Deffayet et al. | |
| 5,661,258 | A * | 8/1997 | Garcia | B63G 7/02 89/1.13 |
| 6,135,387 | A * | 10/2000 | Seidel | F42B 10/16 244/3.1 |
| 2011/0297783 | A1* | 12/2011 | Martinez | F42B 15/01 244/3.21 |
| 2015/0001335 | A1* | 1/2015 | Pettersson | F42B 10/50 244/3.1 |
| 2017/0160057 | A1 | 6/2017 | Skullestad et al. | |
| 2018/0209764 | A1 | 7/2018 | Ginsberg et al. | |
| 2020/0225311 | A1 | 7/2020 | Slocum | |
| 2023/0228527 | A1* | 7/2023 | Squillace | G01C 21/1656 244/3.15 |

FOREIGN PATENT DOCUMENTS

| | | | |
|---|---|---|---|
| WO | 2019108106 | A1 | 6/2019 |
| WO | 2020128460 | A1 | 6/2020 |
| WO | 2021094711 | A1 | 5/2021 |

* cited by examiner

METHOD, FIRE CONTROL SYSTEM AND COMBAT SYSTEM FOR SIMULTANEOUS DETONATION OF PROJECTILES

BACKGROUND AND SUMMARY

The current patent application concerns a method for simultaneous or coordinated detonation of projectiles.

When combating a moving or stationary target with unguided or guided projectiles fired from barreled weapons, the projectiles must be fired at the points where the target will be when the projectiles reach it, or at points close to where the target is located. Such points, usually called forward points, must be predicted. In order to improve impact on the target or to improve the probability of impact on the target, multiple projectiles can be made to burst in the vicinity of the target.

Indirect action, for example in the form of artillery pieces, multiple projectiles can be made to hit ground targets or near ground targets simultaneously or near-simultaneously. This is referred to as MRSI, Multiple Rounds Simultaneous Impact, which is a technique employed in order to fire several projectiles, such as shells, with different charges and/or elevations and thereby make the projectiles land simultaneously or near-simultaneously. MRSI can be fired from one artillery piece but can also interact with ammunition/projectiles fired from several artillery pieces in a system.

In general, MRSI is used for combating ground targets using artillery pieces or grenade launchers against ground targets, where the projectiles explode upon contact with the target or the ground surface.

Examples of method and device for coordinated detonation/burst of several projectiles are given in patent document US 2005/0081705 (A1). The patent document demonstrates that various types of warheads can be made to detonate/burst at the same time by means of utilizing a joint synchronized time.

One additional example of method and device for coordinated detonation/burst of several projectiles is given in patent document U.S. Pat. No. 5,661,258 (A). The patent document demonstrates that different warheads are arranged/placed against a fixed position before joint detonation/burst of the projectiles.

The problem with currently existing solutions according to the above-mentioned document is that there is no indication to improve the coordinated/synergistic detonation by means changing the position of the warhead.

Additional problems which the present invention seeks to solve will become apparent in connection with the following detailed description of the various embodiments.

It is desirable to improve the ability to combat a target by causing several projectiles to explode simultaneously near a target.

By firing a succession of projectiles and braking the projectiles that were fired first, the projectiles can be made to be close to the target at the same time. By making the projectiles burst simultaneously, a greater effect can then be achieved, partly because a larger amount of energetic material can burst at the same time, which means that a larger amount of shrapnel can be generated at the same time, and partly because a certain variation in the position of the projectiles means that a larger area can be covered by shrapnel.

The invention relates, according to an aspect thereof, to a method for simultaneous blasting of projectiles where the following method steps are included; i.) measuring the position of the target, ii.) estimating the target's position, iii.) firing a first projectile at the target, iv.) firing a second projectile at the target, v.) braking the first projectile with a braking device arranged in the projectile, vi.) detonating the projectiles in a coordinated fashion based on an initiation signal.

The purpose of estimating the target's position is that continuous measurement of the target's position is necessarily not always available, for example depending on disturbances, the target moving behind some other object that prevents measurement and so on. By estimating the target's position for a certain point in time, an assumption about the target's position can be made regardless of whether the target's position can be measured or not.

According to additional aspects for the method of simultaneous detonation of projectiles, the following applies;

that additional projectiles are fired at the target.

that the braking device arranged in the projectile is one of;

i.) at least one brake valve arranged in the projectile, ii.) at least one impulse engine arranged in the projectile, iii.) at least one control fin arranged in the projectile, iv.) at least one parachute arranged in the projectile.

that the brake valve arranged in the projectile is a capable of being deployed and retracted so as to change the braking effect acting on the projectile.

that the parachute arranged in the projectile can be removed from the projectile when a certain desired braking effect/velocity has been achieved on the projectile.

that the initiation signal is one of;

i.) a received radio signal, ii.) a predetermined point in time iii.) a predetermined position.

The invention furthermore comprises, according to an aspect thereof, a fire-control system for directing fire against a target comprising at least one sensor, in order to measure the position of the target as a function of time, whereas a method of fire control as described above is utilized.

The invention furthermore comprises, according to an aspect thereof a combat system comprising a launch device, whereas a fire-control system as described above is applied.

According to further aspects of a combat system, the following applies: that the firing device is a system comprised of a barrel-based canon.

The advantage of the present invention is that a target can be fought with greater probability. Since several projectiles can be caused to explode cooperatively and/or synergistically in the vicinity of the target, the probability that the target will be combated by the projectiles increases.

BRIEF DESCRIPTION OF THE DRAWINGS

The invention will be described below by reference to the figures that are included there.

DETAILED DESCRIPTION

Figure 1:
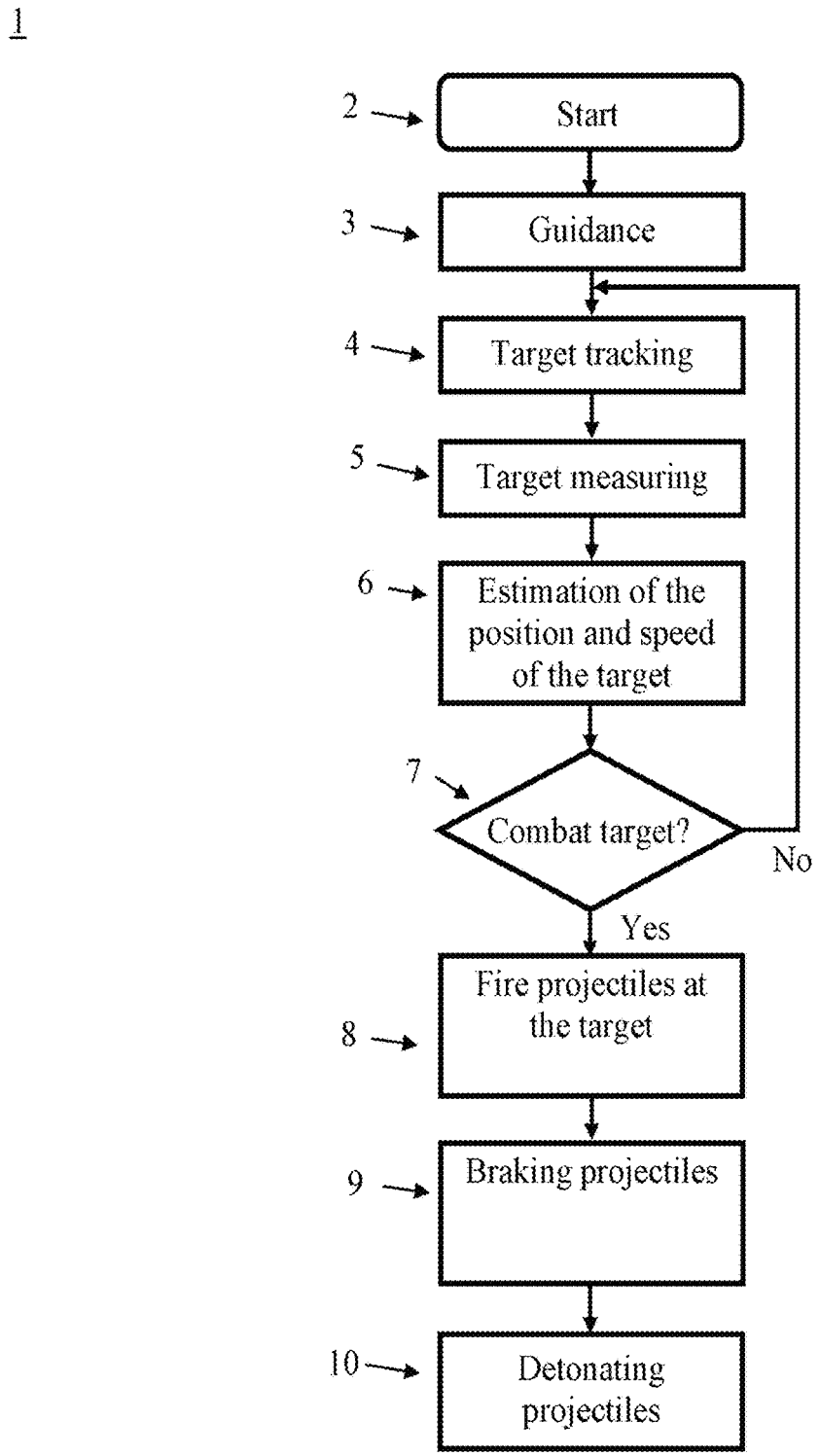
FIG. 1 shows a flow schematic of a method for directing fire against a target according to one embodiment of the invention.

An ejection device, also termed a cannon, a howitzer or a piece, in the sense of a naval artillery piece, has the goal of making use a propellant for the purpose of firing, or ejecting, a projectile. Preferably, a propellant, such as gunpowder, is initiated in one part of the cannon, oftentimes a chamber specifically adapted to the purpose. Initiation takes place by way of igniting the barrel, for instance by means of an ignition cartridge or an igniter in a munitions device, which is initiated by means of striking. Other methods for igniting the propellant may include ignition of the propellant by means of laser energy or electric energy. The propellant burns at a high rate and results in large amounts of gas being produced, which creates a gas pressure in the chamber which propels the projectile out of the barrel of the firing device. The propellant has been adapted in order to generate a constant pressure on the projectile during the entire barrel procedure, to the greatest extent possible, as the projectile movies in the barrel, which results in the projectile leaving the mouth of the barrel with high speed.

Projectiles, such as various types of grenades, generally include some form of warhead and some form of barrel which initiates the warhead. Fuzes can be of various types, and it is common that projectiles intended to burst upon coming into contact with objects to be of the type that requires being struck. Other types of barrels include time barrels, in which projectiles are arranged for purposes of bursting at a certain predetermined time, and proximity fuzes, in which projectiles are arranged for purposes of bursting when an object comes within a certain distance from the projectile. The use of proximity fuzes is preferred when confronting flying vessels, while timed fuzes can be used when confronting a large number of various different objects. It is advantageous to combine various types of fuze functions in one and the same fuze, for instance in order for the projectile to burst after a certain time if it fails to detect any object, and so on.

It is advantageous for the warhead to comprise some type of explosive substance, as well as some type of shattering casing which encloses the explosive substance. Various types of propellants, such as fins, can furthermore be arranged in either fuze or on the body of the projectile. The fuze can be programmed electrically, for example by contacting the fuze or by means of inductive/capacitive programming to make the fuze carry out a certain task or fulfill a certain function. The fuze can also communicate wirelessly, for example with radio or optical communication, thus allowing for the function of the function of the fuze during the projectile's journey towards the target.

An attacking guided craft or another target may intend to damage an attack target or a protected object, depending on the perspective from which the attack target or protected object is viewed. Combating the target means that the target is affected so that it can no longer damage the protected object towards which the target is traveling.

A system designed to engage targets using barreled weapons and unguided or guided projectiles can be considered to consist of or comprise three parts: fire control, weapons and projectiles. Such a system will henceforth be referred to as air defense artillery. Unguided projectiles refer to various forms of projectiles, such as grenades and rockets, which are intended to be used for combating targets. When guided projectiles are utilized, projectiles with guidance capability are used, after which additional systems for communication with the guided projectiles are added. The guided projectiles can also be autonomous and outfitted with, for instance, target seekers that enable them to guide themselves towards the target. Furthermore, targets can be combated with missiles.

Fire control that constitutes part of an air defense artillery system includes one or more sensors, as well as several methods for handling and evaluating sensor data. The sensor or sensors that are included in, and used by, the fire line will henceforth be referred to as sights.

Refined information from the sight is used to control the alignment of both sight and weapon.

A combat process can be considered to consist of or comprise a number of activities. Some activities must take place in sequence while others can take place in parallel.

In FIG. 1, a flowchart for a method in a fire-control system 1 is described. When combat begins, start 2 in FIG. 1, the sight is aimed at the target to be combated. This is usually made possible by an external unit, for example a surveillance radar, continuously delivering information about the target's position as a function of time. The external unit can, for example, be arranged on the platform where the firing system is arranged, for example a ship. This external device is called the guidance device. The procedure is called guidance 3.

In parallel with aiming the sight at the target, the barrel, or the action device, can be aimed at a preliminarily calculated forward point, the position of which is based on data from the aiming unit. In this way, the time for firing the barrel is reduced when a more accurate forward point has been calculated because the preliminarily calculated forward point will be close to the more accurate, later calculated forward point.

Completed guidance means that the sight may have the opportunity to itself measure the position of the target. However, it is not certain that the sight will be able to detect the target immediately-even though it is correctly aimed. In cases where the target constantly gets closer, the probability of the sight being able to detect the target increases. The even that takes place when this occurs is called target capture. Target capture is the start of a new sequence called target tracking 4. The sight then controls its own line of sight so that the line of sight follows the target.

When target tracking 4 has been established, target measurement 5 starts. The sight now tries to measure both direction and distance to the target. It is not guaranteed that the sight will be able to measure the distance to the target immediately when a target measurement 5 is started. However, sooner or later, the sight will begin delivering distance data. Meanwhile, the position of the target and the preliminary forward point can be calculated by combining the angle data from the sight and the range data from the guidance device.

When the sight can finally generate both direction data and distance data, no guidance data is longer required for purposes of controlling the sight and barrel. However, guidance data may be used for other purposes.

When the sight measures the position of the target, during target measurement 5, it usually achieves higher frequency and better accuracy than the guidance sensor is capable of This is the basic reason why two types of sensors are used, surveillance sensors and fire-control sensors.

The measurement data is used for an estimation of the target's position and speed 6. By utilizing knowledge of the position of the protected object that the target is intended to hit, the target's trajectory can be predicted with greater accuracy. The current position and velocity of the target can be estimated from the raw data, for example in the manner already described.

At a certain time, a choice can be made to Combat target 7, in the event that the target is not fought, the method can be repeated from step 4 target tracking until a possible better time is available to combat the target.

If the choice is to combat the target, projectiles can be fired at the target as shown in Firing projectiles at the target 8, it is also possible to improve information about the target's trajectory in various ways before firing, for example by estimating the target's acceleration.

At a certain point in time or at a certain position in the trajectory of the projectile, braking of the projectile can be initiated, which is shown in method step Braking projectiles 9. Braking can be done with brake flaps, braking by tilting the projectile, braking by means of the movement pattern of the projectile in the trajectory, braking with a parachute.

A projectile can be designed with brake flaps or other deployable and possibly retractable braking device that can be deployed in the projectile's trajectory and bring a braking ability to the projectile. Preferably, the brake flaps are arranged so that the braking effect only affects the speed of the projectile and not the trajectory of the projectile in a radial direction. Furthermore, the projectile can be slowed by tilting the projectile, for example through an impulse engine arranged in the projectile, for example in accordance with the description in patent document SE 1700079-5. Furthermore, the projectile can be slowed by a steerable projectile changing its trajectory to reduce the speed, for example through strong turning movements with the aim of reducing the speed during the projectile's path towards the target object or target area. A further alternative for slowing the projectile is to outfit the projectile with a deployable parachute which slows the projectile once deployed. In one embodiment the parachute can also be removed if the right speed/sufficient braking has been achieved.

In method step Shatter projectiles 10, all projectiles within a certain area are made to shatter together, simultaneously, near-simultaneously or synergistically. Joint detonation is obtained as a result of a specific initiation signal which can be achieved by, for example, an external signal such as a radio signal, at a predetermined point in time or at a certain position. In one embodiment, the first projectile initiates detonation of subsequent projectiles based on sensor data acquired from the first projectile, such as an indication that the target is close to the present proximity fuze in the first projectile, which then sends a signal to other nearby projectiles to jointly detonate.

Figure 2:
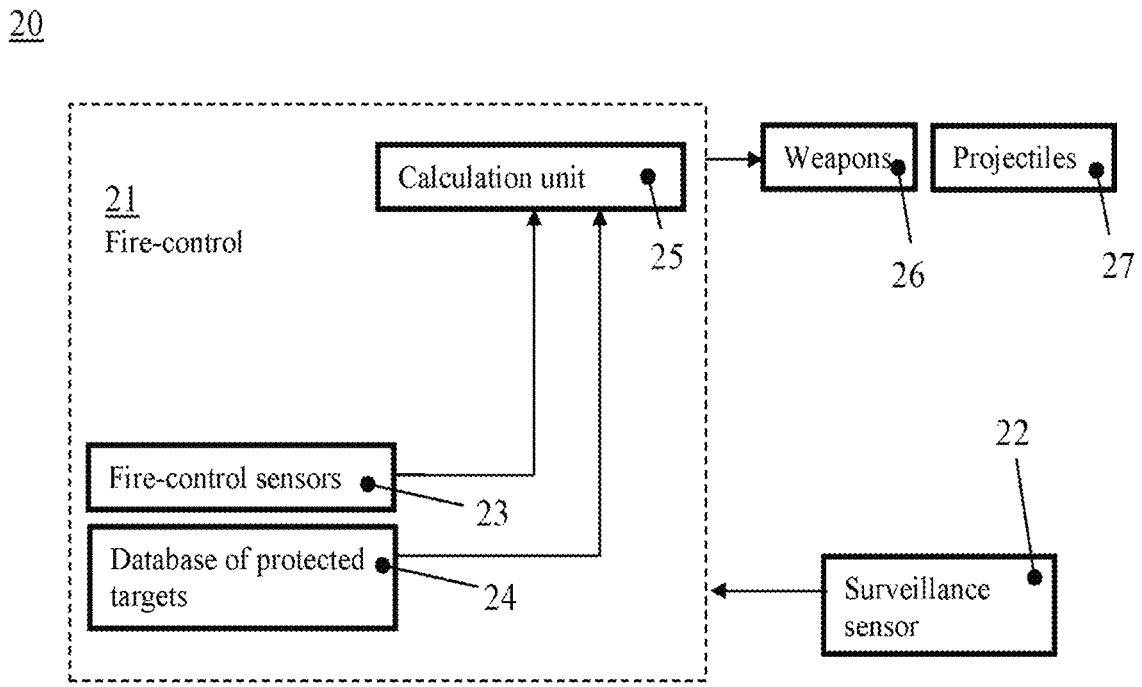
FIG. 2 shows a block diagram of a device for combating targets according to one embodiment of the invention.

An air defense artillery system 20, as shown in FIG. 2, including a type of fire control 21, one or more weapons 26 and projectiles 27 that can be fired at targets. The system 20 receives input from an external surveillance sensor 22, which can search very large volumes with great depth at the expense of accuracy and measurement frequency. The air defense artillery system 20 includes a fire-control sensor 23 which, after training, can measure the position of the individual target in a small sector with limited depth, but with high accuracy and high measurement frequency. The calculation unit 25 is used to calculate the forward points towards which the weapon 26 should be aimed. The fire direction 21 may also include a protected object database 24 that contains positions for a number of protected objects that can be found in the immediate area around the air defense artillery system 20. Weapons 26 and projectiles 27 can also constitute missiles.

Figure 3A:
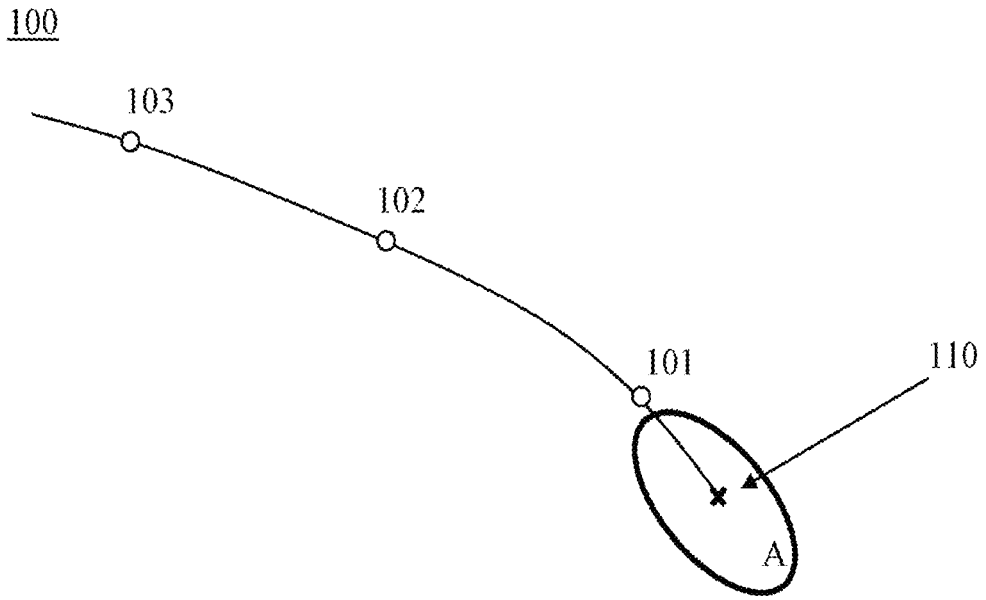
FIG. 3*a* shows three projectiles aimed at a target in a first position according to one embodiment of the invention.

FIG. 3*a* shows three projectiles 101, 102, 103 fired at a target 110 in a first position The first projectile 101 was fired before projectile 102. Projectile 103 was fired after projectile 102, from a launching device. The first projectile 101 has begun the braking process as the projectile approaches the target 110 and target area A.

Figure 3B:
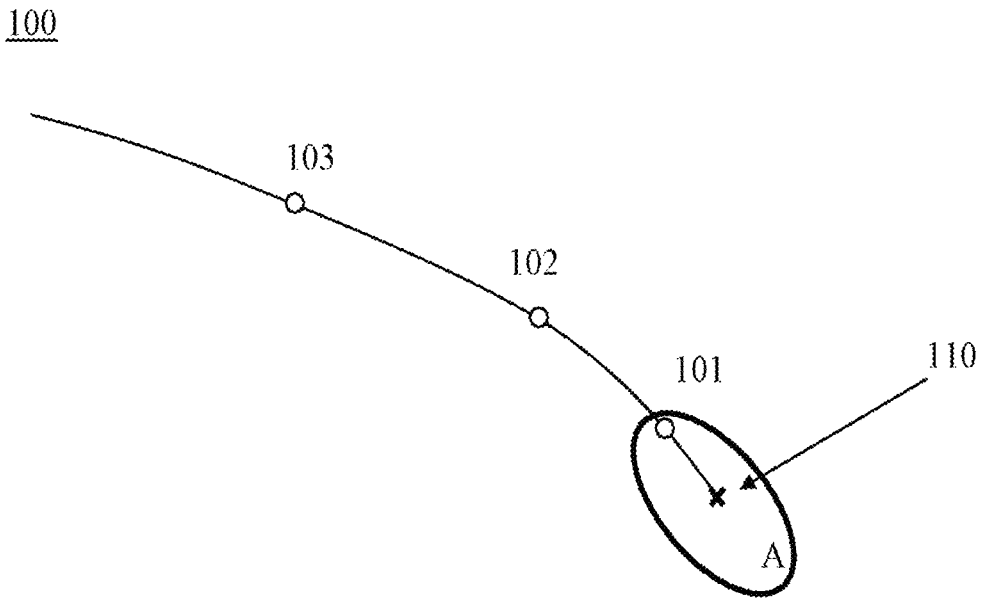
FIG. 3*b* shows a three projectiles aimed at a target in a second position according to one embodiment of the invention.

In FIG. 3*b*, the three projectiles 101, 102 and 103 have approached the target and are in a second position. Projectile 102 begins to brake. Projectile 101 continues to brake, and the velocity of the projectile has decreased, which means that the distance that projectile 101 has traveled from the first position to the second position is relatively short.

Figure 3C:
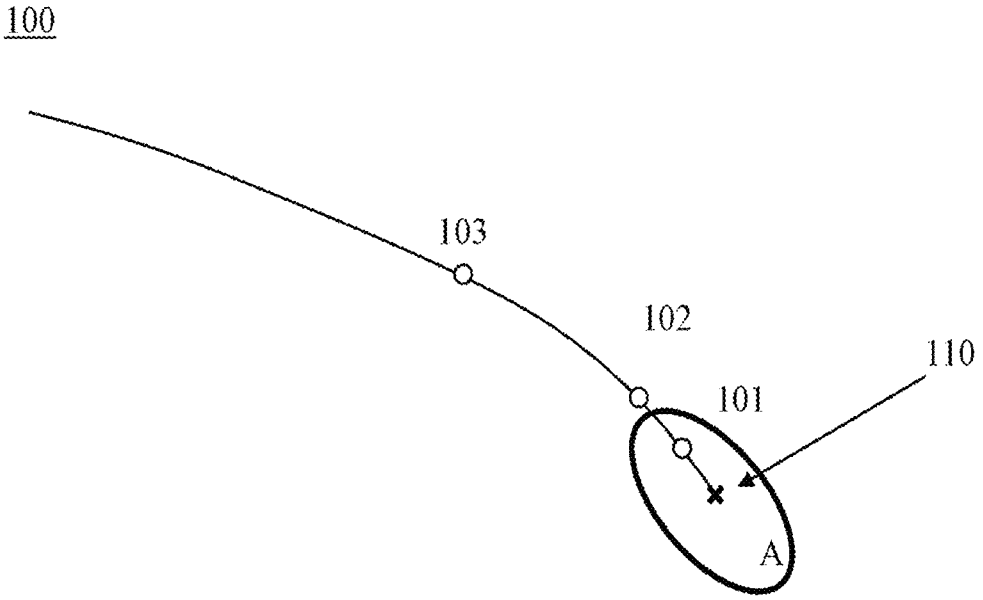
FIG. 3*c* shows three projectiles aimed at a target in a third position according to one embodiment of the invention.

In FIG. 3*c*, the three projectiles 101, 102 and 103 have approached the target and are in a third position. Now both projectile 101 and projectile 102 are braking, and the speed of the projectiles has decreased, which means that the distance that projectiles 101 and 102 have traveled from the second position to the third position is relatively short. Projectiles 101 and 102 are approaching target 110 and projectile 101 is in target area A.

Figure 3D:
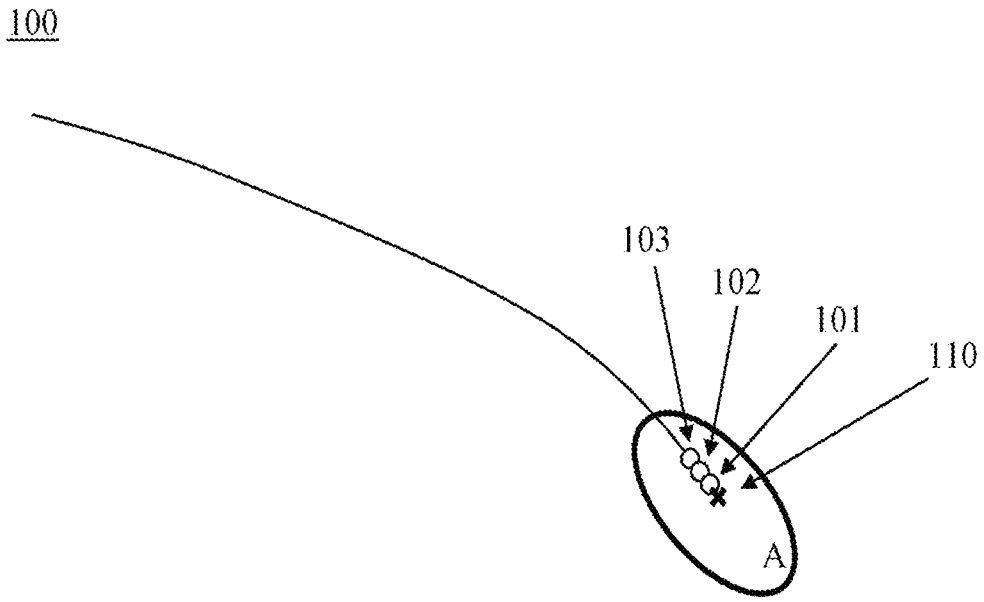
FIG. 3*d* shows a three projectiles aimed at a target in a fourth position according to one embodiment of the invention.

In FIG. 3*d*, the three projectiles 101, 102 and 103 have entered target area A and are in a fourth position. Projectiles 101, 102 and 103 are relatively close to each other and relatively close to the target 110. At a certain time, the warheads of projectiles 101, 102, and 103 detonates simultaneously, near-simultaneously, or in a coordinated fashion. The effect of the projectiles acts synergistically on the target and in target area A, by means of shrapnel being distributed in target area A and acting on target 110.

The invention is not limited to the embodiments specifically shown, but can be varied in different ways within the framework of the claims.

For instance, it is clear that the elements and details included in the method for directing fire towards targets, such as the number of sensors, firing devices or systems, are to be adapted to the weapons system, platform or other construction properties which currently apply.

It is to be understood that the method described above for directing fire against targets can be applied to basically all unguided or guided craft and systems including aircraft, unmanned flying craft and missiles, surface-going ships or underwater craft that are possible to measured.

The invention claimed is:

1. A method for simultaneous detonation of projectiles, comprising i.) measuring a target's position by an external surveillance unit, ii.) estimating a position of the target based on a calculation using time and range using a fire-control sensor, iii.) firing a first projectile towards the target, iv.) firing a second projectile towards the target, v.) changing the position of the first projectile and the second projectile on the way to the target, wherein the first projectile and the second projectile are directed at the target, vi.) detonating the first and second projectiles in a coordinated fashion based on an initiation signal.

2. The method for simultaneous detonation of projectiles according to claim 1, comprising firing additional projectiles at the target.

3. The method for simultaneous detonation of projectiles according to claim 1, further including a braking device wherein the braking device arranged in the projectile is one of:

i.) at least one brake valve arranged in the projectile, ii.) at least one impulse engine arranged in the projectile, iii.) at least one control fin arranged in the projectile, iv.) at least one parachute arranged in the projectile.

4. The method for simultaneous detonation of projections according to claim 3, wherein the braking device is the brake valve arranged in the projectile, and the brake valve arranged in the projectile is Adapted to be deployed and retracted so as to change the braking effect acting on the projectile.

5. The method for simultaneous detonation of projections according to claim 3, wherein the braking device is the parachute arranged in the projectile, and the parachute arranged in the projectile is removed from the projectile when a certain desired braking effect/velocity has been achieved on the projectile.

6. The method for simultaneous detonation of projectiles according to claim 1, wherein the initiation signal is any of:

i.) a received radio signal to all the projectiles, ii.) a predetermined time, iii.) a predetermined position, or iv) a signal from the first fired projectile to the remaining projectiles.

7. A combat system including a firing device and a fire control system for directing fire against a target, the combat system utilizing the method for simultaneous detonation of projectiles according to claim 1.

8. The combat system according to claim 7, wherein the firing device is a barrel-based cannon system.

* * * * *